US007724195B2

(12) United States Patent
Yuba et al.

(10) Patent No.: US 7,724,195 B2
(45) Date of Patent: May 25, 2010

(54) ANTENNA APPARATUS

(75) Inventors: Takashi Yuba, Shinagawa (JP); Shigemi Kurashima, Shinagawa (JP); Hideki Iwata, Shinagawa (JP); Masahiro Yanagi, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 447 days.

(21) Appl. No.: 11/492,074

(22) Filed: Jul. 25, 2006

(65) Prior Publication Data

US 2007/0146214 A1 Jun. 28, 2007

(30) Foreign Application Priority Data

Dec. 28, 2005 (JP) ..... 2005-378396

(51) Int. Cl.
*H01Q 1/24* (2006.01)

(52) U.S. Cl. ..... 343/702; 343/906

(58) Field of Classification Search ..... 343/702, 343/906

See application file for complete search history.

(56) References Cited

U.S. PATENT DOCUMENTS

| | | | | |
|---|---|---|---|---|
| 5,513,383 | A | 4/1996 | Tsao | |
| 5,973,645 | A * | 10/1999 | Zigler et al. | 343/702 |
| 6,181,284 | B1 * | 1/2001 | Madsen et al. | 343/702 |
| 6,292,146 | B1 * | 9/2001 | Melax | 343/702 |
| 6,646,612 | B1 * | 11/2003 | Noguchi et al. | 343/702 |
| 7,511,668 | B2 | 3/2009 | Hirabayashi | |
| 2005/0119027 | A1 * | 6/2005 | Sanchez et al. | 455/557 |

FOREIGN PATENT DOCUMENTS

| | | |
|---|---|---|
| JP | 5-14026 | 1/1993 |
| JP | 7-115380 | 5/1995 |
| JP | 2002-290256 | 10/2002 |
| JP | 2004-128982 | 4/2004 |
| JP | 2005-184565 | 7/2005 |
| JP | 2005-295194 | 10/2005 |

OTHER PUBLICATIONS

Takuya Taniguchi et al., "An Omnidirectional and Low-VSWR Antenna for the FCC-Approved UWB Frequency Band", 2003 IEICE (The Institute of Electronics, Information and Communication Engineers) General Conference, Mar. 22, 2003.

Japanese Office Action issued Jan. 19, 2010 in corresponding Japanese Patent Application 2005-378396.

* cited by examiner

*Primary Examiner*—Tho G Phan
(74) *Attorney, Agent, or Firm*—Staas & Halsey LLP

(57) ABSTRACT

An antenna apparatus includes an antenna case housing an antenna; a connector to be connected to a device which connector is electrically connected to the antenna; and an antenna case supporting mechanism which supports the antenna case and enables changing a position of the antenna case at least to a horizontal position and a vertical position.

9 Claims, 19 Drawing Sheets

100
11
80
30
60
301
201
202
70
300
X1
X2
Y1
Y2
Z1
Z2

ANTENNA APPARATUS

BACKGROUND OF THE INVENTION

1. Field of the Invention

The present invention generally relates to an antenna apparatus, and more particularly relates to an antenna apparatus which includes a UWB antenna encased in an antenna case and is normally attached to another apparatus when used.

2. Description of the Related Art

In recent years, wireless communication technologies using UltraWideBand (UWB) have gotten a lot of attention because of UWB's wide range of applications such as radar positioning and high capacity transmission. In 2002, the Federal Communications Commission (FCC) of the United States approved the use of UWB in the frequency band between 3.1-10.6 GHz.

UWB is a transmission system which uses ultrawideband signals for communication. An antenna used for UWB must be capable of sending/receiving ultrawideband signals.

An antenna, which is composed of a base board and a power feeder, for use in the frequency band between 3.1-10.6 GHz approved by FCC has been proposed (non-patent document 1).

[Non-patent document 1] 2003 IEICE (The Institute of Electronics, Information and Communication Engineers) General Conference, Mar. 22, 2003, Room B201, B-1-133: An Omnidirectional and Low-VSWR Antenna for the FCC-Approved UWB Frequency Band, Takuya Taniguchi and Takehiko Kobayashi (Tokyo Denki University).

An antenna as described above has a use for devices such as a personal computer and a mobile communication device, and there has been a demand for a more compact and thinner antenna.

In Japanese Patent Application No. 2005-160286 titled "Antenna Apparatus" filed by the same applicant as the present application, a compact and thin antenna for UWB is proposed.

To attach such an antenna to a device and to actually use the antenna, an easy-to-use antenna apparatus for adjusting the position of the antenna to achieve good reception is necessary.

SUMMARY OF THE INVENTION

The present invention provides an antenna apparatus that substantially obviates one or more problems caused by the limitations and disadvantages of the related art.

Embodiments of the present invention provide an antenna apparatus which makes it possible to easily adjust the position of an antenna to achieve good reception.

According to an embodiment of the present invention, an antenna apparatus includes an antenna case housing an antenna; a connector to be connected to a device which connector is electrically connected to the antenna; and an antenna case supporting mechanism which supports the antenna case and enables changing a position of the antenna case at least to a horizontal position and a vertical position.

The antenna case supporting mechanism of the antenna apparatus according to an embodiment of the present invention allows the user to easily adjust the position of the antenna case at least to a horizontal position and a vertical position, thereby making it easier for the user to adjust the antenna to a horizontally polarized wave and a vertically polarized wave.

DETAILED DESCRIPTION OF THE PREFERRED EMBODIMENTS

Preferred embodiments of the present invention are described below with reference to the accompanying drawings.

[Outline of Antenna Apparatus]

Figure 1:
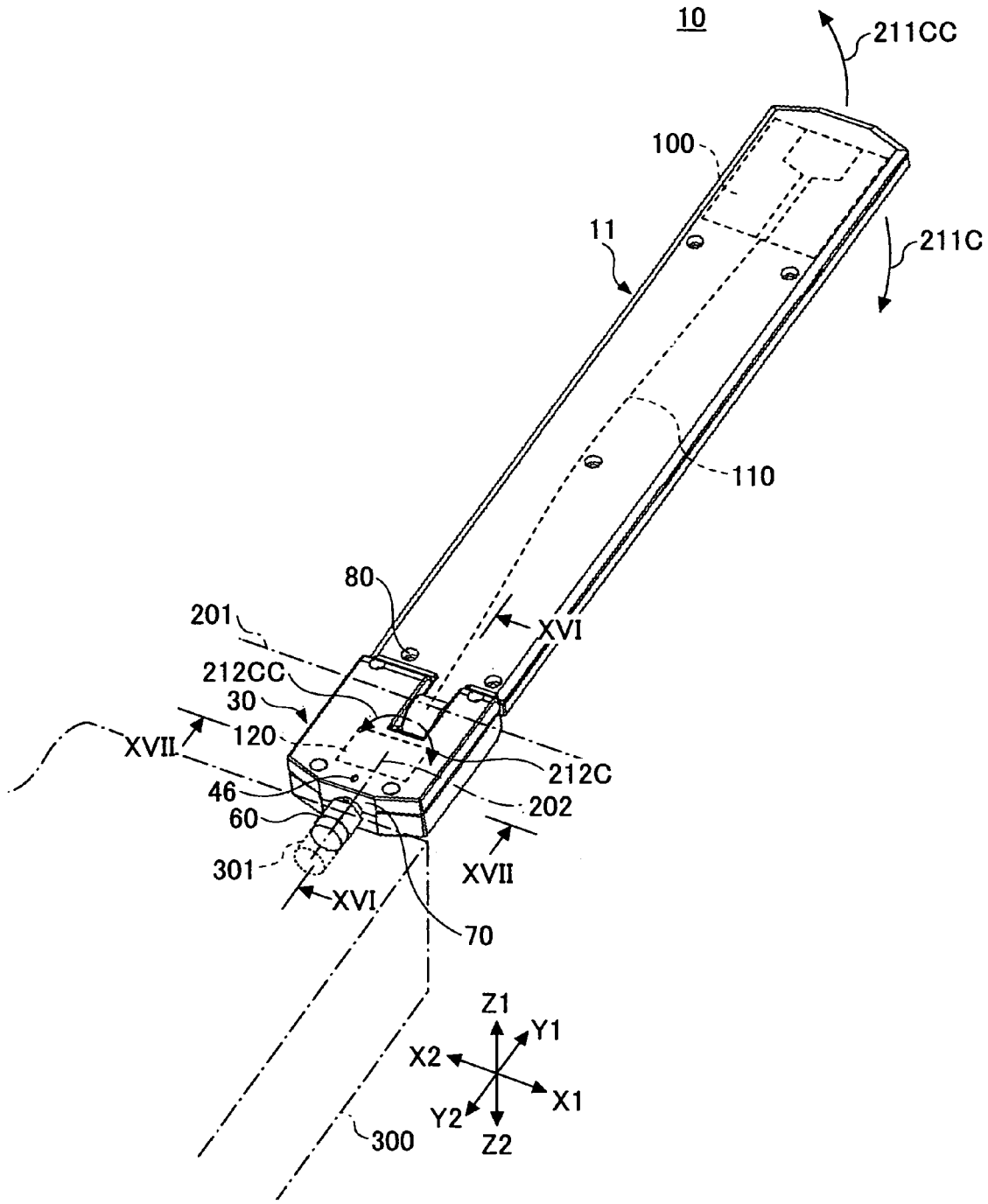
FIG. 1 is a perspective view of an antenna apparatus according to an embodiment of the present invention.
Figure 2B:
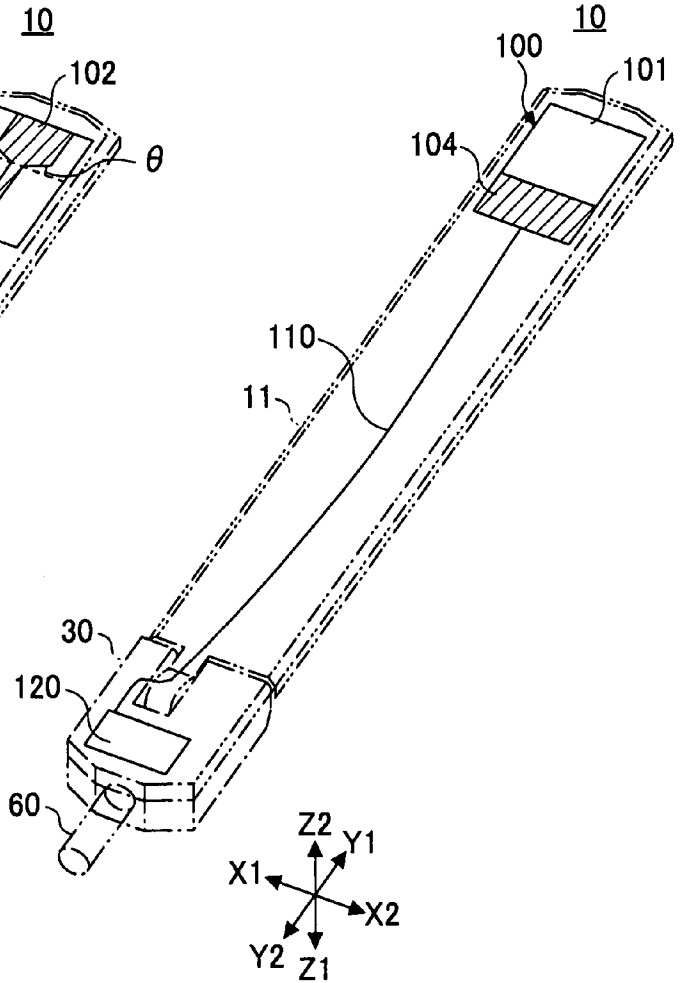
FIG. 2B is a back transparent view of the antenna apparatus shown in FIG. 1.
Figure 2A:
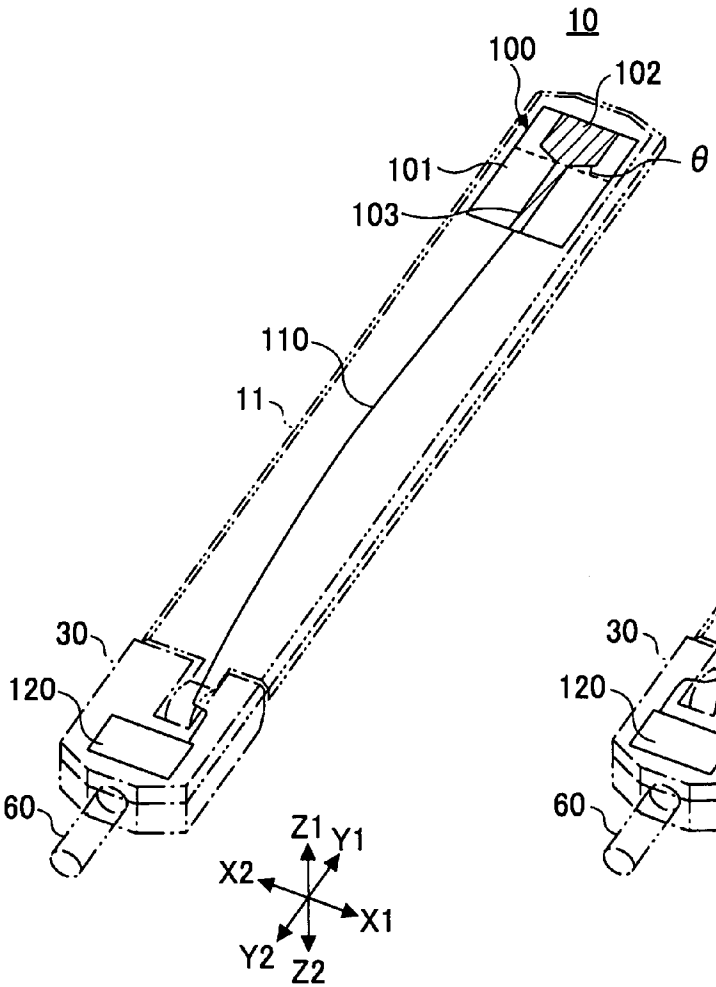
FIG. 2A is a front transparent view of the antenna apparatus shown in FIG. 1.

FIG. 1 is a perspective view of an antenna apparatus 10 according to an embodiment of the present invention. FIG. 2A is a front transparent view of the antenna apparatus 10; and FIG. 2B is a back transparent view of the antenna apparatus 10. Arrows X1-X2 show the width directions, Y1-Y2 show the length directions, and Z1-Z2 show the thickness directions. The Y2 side is the bottom of the antenna apparatus 10 and the Y1 side is the head of the antenna apparatus 10.

FIG. 3, FIG. 4, and FIGS. 5A through 5C illustrate an antenna case in various positions.

The antenna apparatus 10 is used to send/receive UWB signals. As shown in FIG. 1, the antenna apparatus 10 has a shape of a long narrow board and includes an antenna case 11, a connector case 30, and a coaxial connector 60. Also, as shown in FIGS. 2A and 2B, the antenna apparatus 10 includes, in its interior, a UWB antenna 100, a coaxial cable 110, and a connecting board 120. The coaxial connector 60 protrudes from the Y2 end of the antenna apparatus 10 in the Y2 direction. The coaxial connector 60 is positioned at the bottom of the antenna apparatus 10 and the UWB antenna 100 is positioned at the head of the antenna apparatus 10. The UWB antenna 100 is in the antenna case 11.

A part of the coaxial connector 60 is housed in the connector case 30. A screw connector 64 of the coaxial connector 60 protrudes from the connector case 30 in the Y2 direction. A second axis 202 of the coaxial connector 60 is parallel to the Y1-Y2 directions. The connecting board 120 is fixed to the Y1 end of the coaxial connector 60. The connecting board 120 is housed in a space 45 inside the connector case 30 (see FIG. 16).

The coaxial cable 110 extends from the UWB antenna 100 through the antenna case 11 in the Y2 direction. The coaxial cable 110 runs through an antenna case supporting mechanism 80 described later into the connector case 30. The Y2 end of the coaxial cable 110 is connected to the connecting board 120. In this way, the antenna 100 is electrically connected to the coaxial connector 60 via the coaxial cable 110 and the connecting board 120.

The connector case 30 is joined to the coaxial connector 60 by a connector case supporting mechanism 70. The connector case 30 is rotatably joined to the coaxial connector 60 (which is non-rotatably fixed to the coaxial connector of a device) by the connector case supporting mechanism 70. The connector case 30 is rotatable in the directions of arrows 212C and 212CC around the second axis 202 in the X-Z plane within an angle β.

The antenna case 11 is rotatably joined to the connector case 30 by the antenna case supporting mechanism 80. The antenna case 11 is rotatable stepwise in the directions of arrows 211C and 211CC around a first axis 201 (an X1-X2 axis) of the connector case 30 in the Y-Z plane within an angle α. The antenna case supporting mechanism 80 locks the antenna case 11 at every 30 degrees within the angle α.

As shown in FIG. 1, the antenna apparatus 10 is attached to a device, for example, a personal computer 300, by screwing the screw connector 64 of the coaxial connector 60 into a coaxial connector 601 of the personal computer 300. In FIG. 1, the antenna apparatus 10 is in the X-Y plane and the antenna case 11 is positioned at zero degrees (in a horizontal position).

Figure 3:
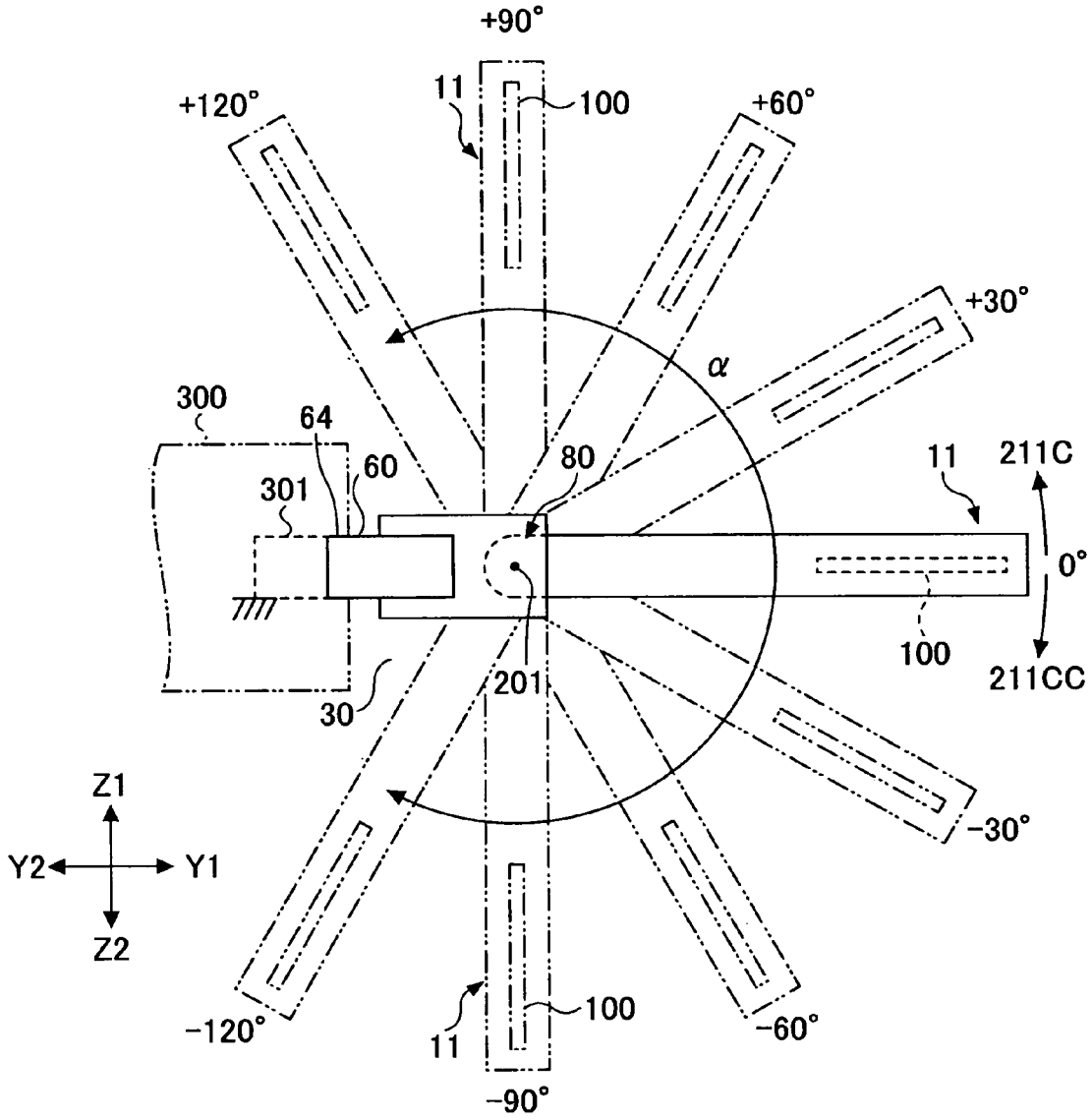
FIG. 3 is a drawing used to describe how an antenna case of an antenna apparatus attached to a device is rotated stepwise in a Y-Z plane.

FIG. 3 shows the range within which the antenna case 11 joined to the connector case 30 by the antenna case supporting mechanism 80 can be rotated. In FIG. 3, rotation angles in the counterclockwise direction or upward direction are indicated by "+", and rotation angles in the clockwise direction or downward direction are indicated by "−". The antenna case 11 can be locked at every 30 degrees within the angle α between +120 degrees and −120 degrees. The antenna case 11 can be locked at 0 degrees, +30 degrees, +60 degrees, +90 degrees (upward vertical position), +120 degrees, −30 degrees, −60 degrees, −90 degrees (downward vertical position), and −120 degrees.

As described above, the antenna case supporting mechanism 80 makes it possible to easily position the antenna case 11 at 0 degrees, +90 degrees (upward vertical position), and −90 degrees (downward vertical position). In other words, the antenna case supporting mechanism 80 makes it possible to easily adjust the UWB antenna 100 to a horizontally polarized wave and a vertically polarized wave.

Figure 4:
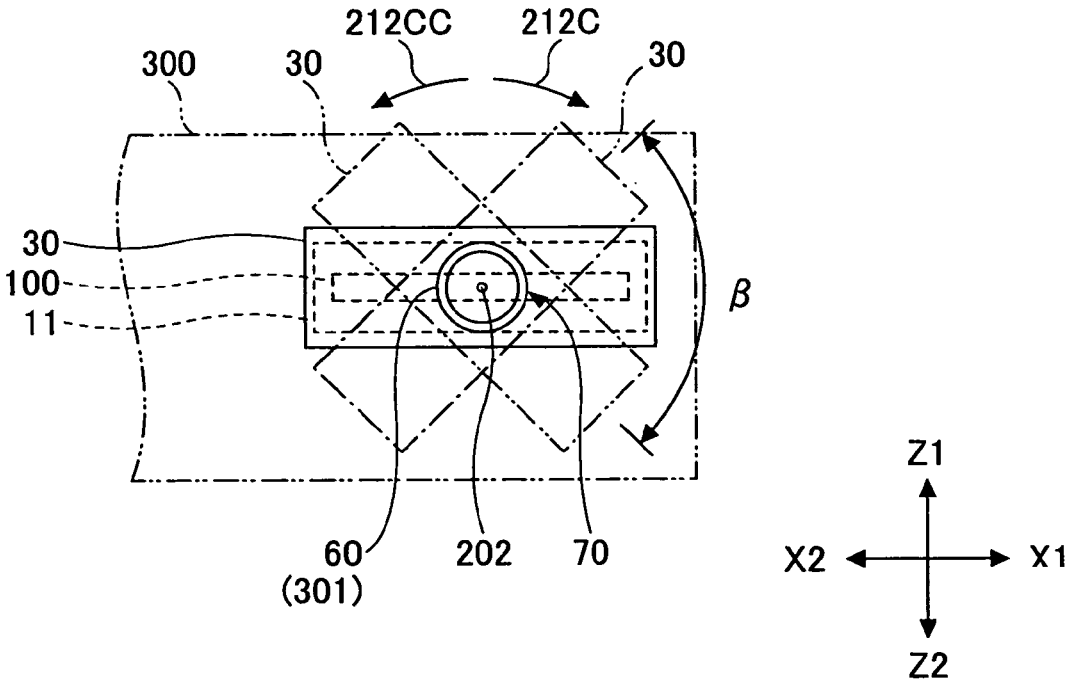
FIG. 4 is a drawing used to describe how an antenna case of an antenna apparatus attached to a device is rotated in an X-Z plane.

FIG. 4 is a drawing illustrating the antenna apparatus 10 in FIG. 1 seen from the Y2 side and shows the range within which the connector case 30 joined to the coaxial connector 60 by the connector case supporting mechanism 70 can be rotated. The connector case 30 is rotatable around the coaxial connector 60 within the angle β (about 100 degrees) and is kept at a desired angle by friction of rubber as described later. When the connector case 30 is rotated around the coaxial connector 60, the antenna case 11 is rotated together with the connector case 30.

Figures 5A, 5B, 5C:
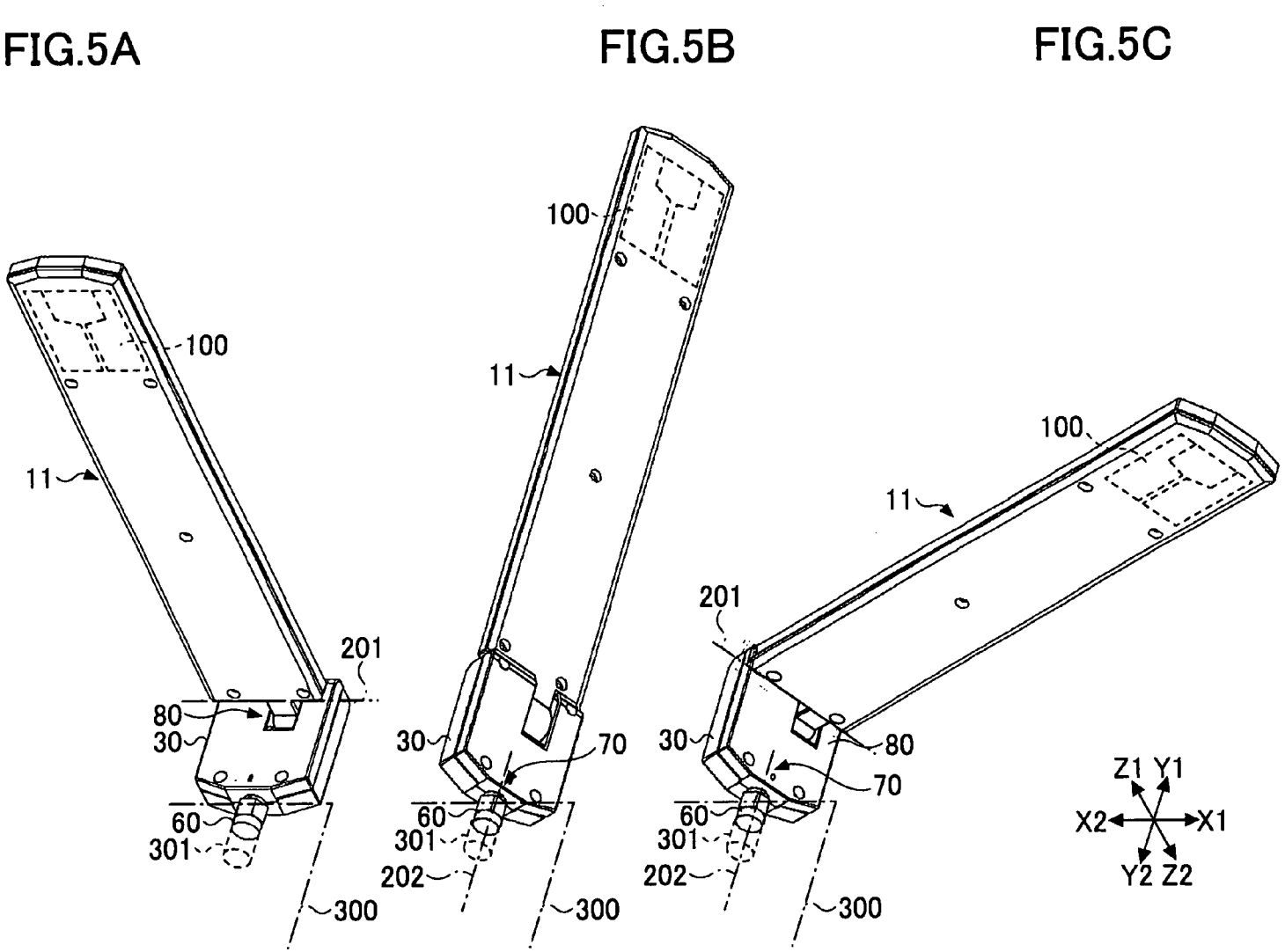
FIGS. 5A through 5C are drawings used to describe how the direction of an antenna case of an antenna apparatus attached to a device is changed.
Figure 6A:
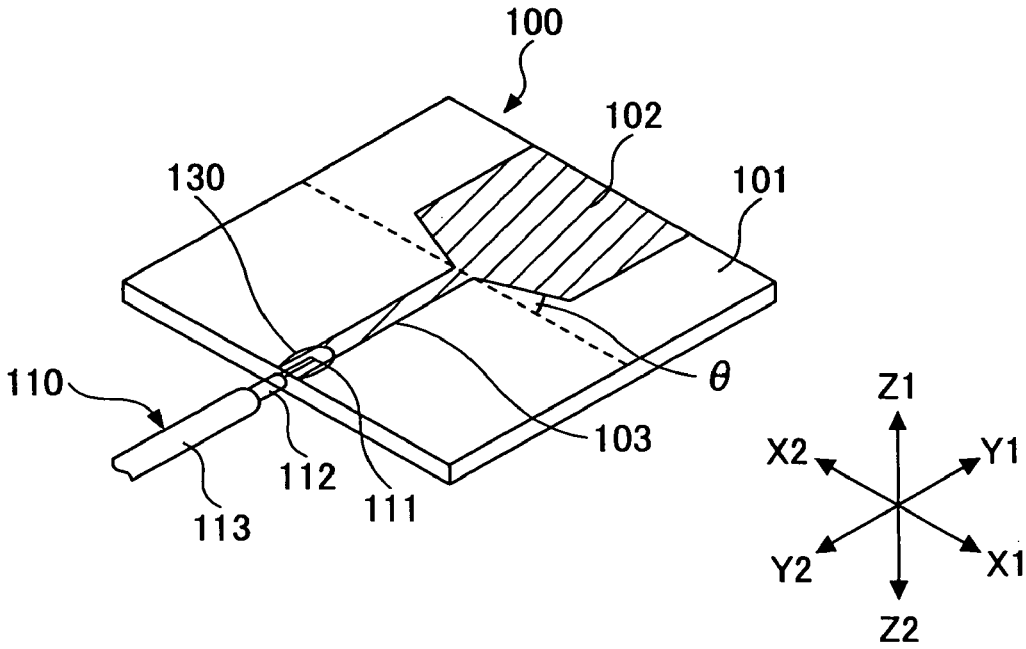
FIG. 6A is a front perspective view of a UWB antenna.
Figure 6B:
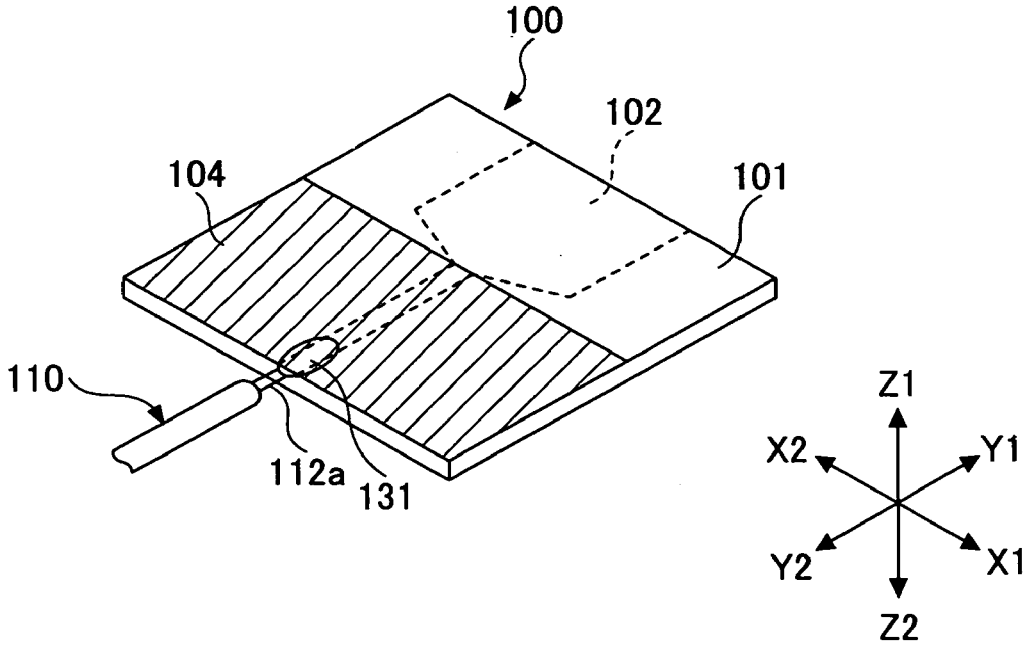
FIG. 6B is a back perspective view of the UWB antenna.

When the antenna apparatus 10 is attached to the personal computer 300 to send/receive signals, the position of the UWB antenna 100 can be adjusted as shown in FIGS. 5A, 5B, and 5C to achieve good reception.

FIG. 5A shows the antenna case 11 rotated to a position perpendicular to the connector case 30.

In FIG. 5B, the connector case 30 is rotated a certain number of degrees around the coaxial connector 60 and, as a result, the antenna case 11 is rotated a certain number of degrees around the second axis 202 into an inclined position.

In FIG. 5C, the antenna case 11 is rotated a certain number of degrees around the first axis 201 of the connector case 30 and the connector case 30 is rotated a certain number of degrees around the coaxial connector 60. As a result, the antenna case 11 is positioned at a "+" angle and also inclined. The user can rotate the connector case 30 around the coaxial connector 60 by holding and rotating the antenna case 11.

Parts of the antenna apparatus 10 are described in detail below.

[UWB Antenna 100]

As shown in FIGS. 2A and 2B and FIGS. 6A and 6B, the UWB antenna 100 includes a dielectric board 101. A home-plate-shaped element pattern 102 and a microstrip line 103 are formed on the upper surface of the dielectric board 101, which microstrip line 103 provides electrical connectivity to the element pattern 102. On a portion of the back surface of the dielectric board 101 which portion corresponds to the microstrip line, a ground pattern 104 is formed.

The characteristics of the antenna apparatus 10 change according to an angle θ between a side of the element pattern 102 and a side of the ground pattern 104.

Figure 7:
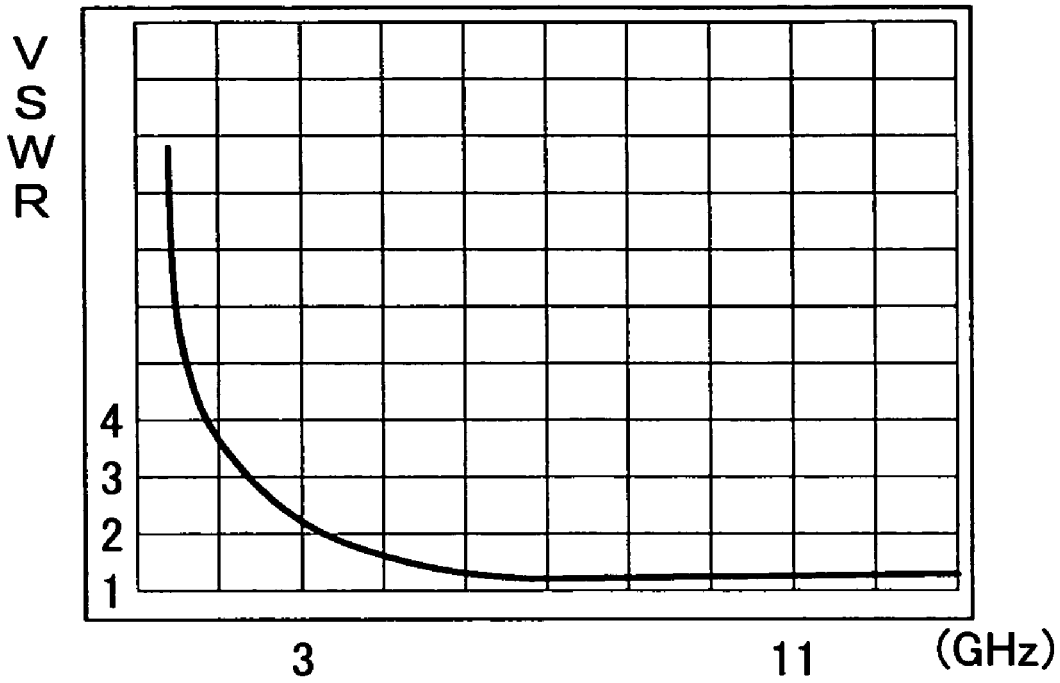
FIG. 7 is a graph showing VSWR vs. frequency characteristics of a UWB antenna.

The UWB antenna 100 has VSWR (voltage standing wave ratio) vs. frequency characteristics as shown in FIG. 7. In the frequency band between 3.1-10.6 GHz where the UWB antenna 100 is to be used, the VSWR is equal to or lower than 1.4.

The UWB antenna 100 may also include a filter in the middle of the microstrip line 103.

[Coaxial Cable 110]

The coaxial cable 110 has a structure where an electric wire 111 is covered by a braided wire 112, and the braided wire 112 is covered by an insulating sheath 113. The Y1 end of the electric wire 111 of the coaxial cable 110 is soldered to the Y2 end of the microstrip line 103 by solder 130, and an end 112*a* of the braided wire 112 is soldered to the ground pattern 104 by solder 131. An electrically conductive adhesive or laser welding may be used instead of solder.

For the connection between the coaxial cable 110 and the UWB antenna 100, high frequency connectors may also be used. In this case, a high frequency connector is attached to the Y1 end of the coaxial cable 110 and another high frequency connector is attached to the Y2 end of the microstrip line 103 of the UWB antenna 100, and the two high frequency connectors are joined.

[Connecting Board 120]

Figure 8A:
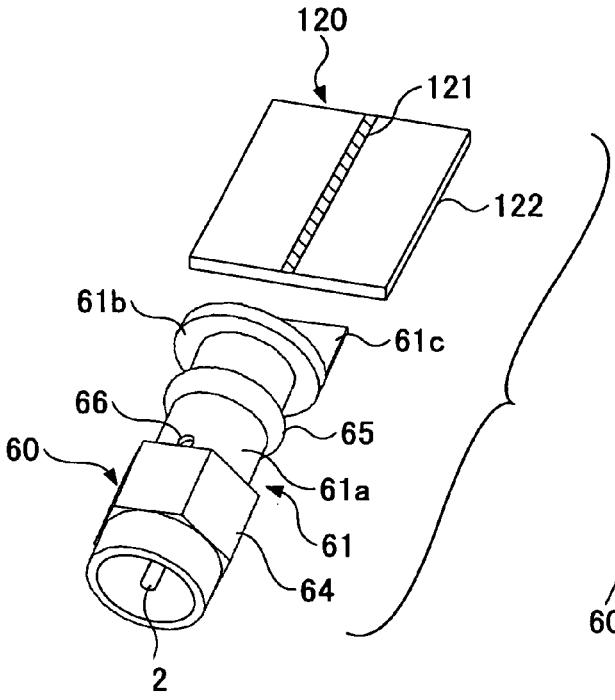
FIGS. 8A and 8B are perspective views of a pair of a coaxial connector and a connecting board seen from the Y2 direction.
Figure 8B:
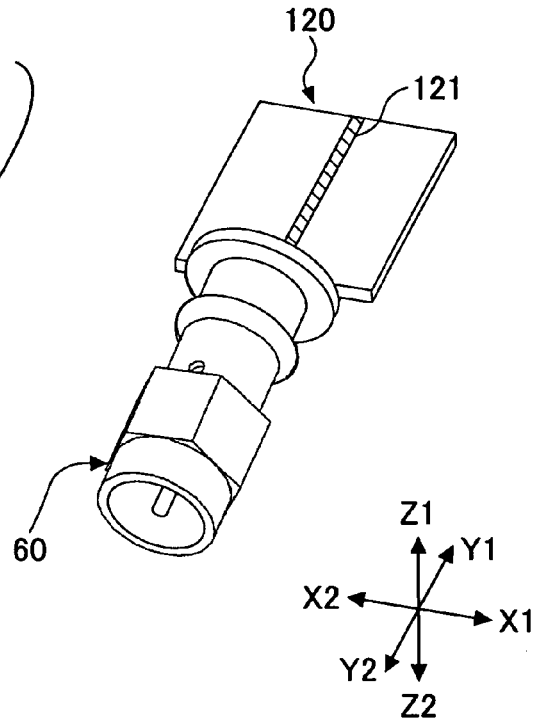
Figure 9A:
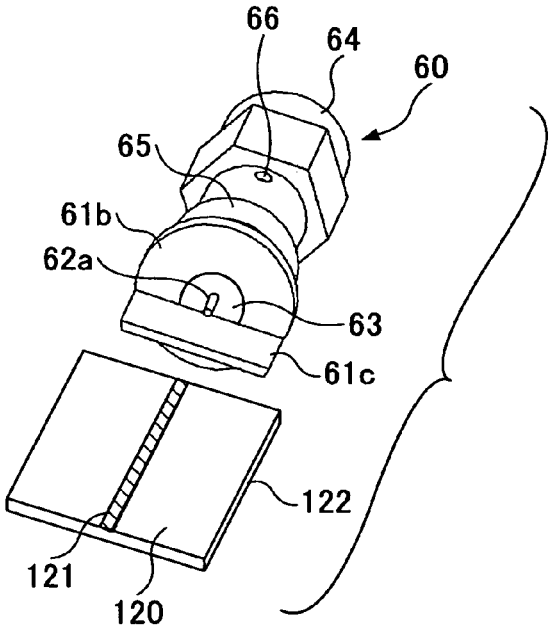
FIGS. 9A and 9B are perspective views of a pair of a coaxial connector and a connecting board seen from the Y1 direction.
Figure 9B:
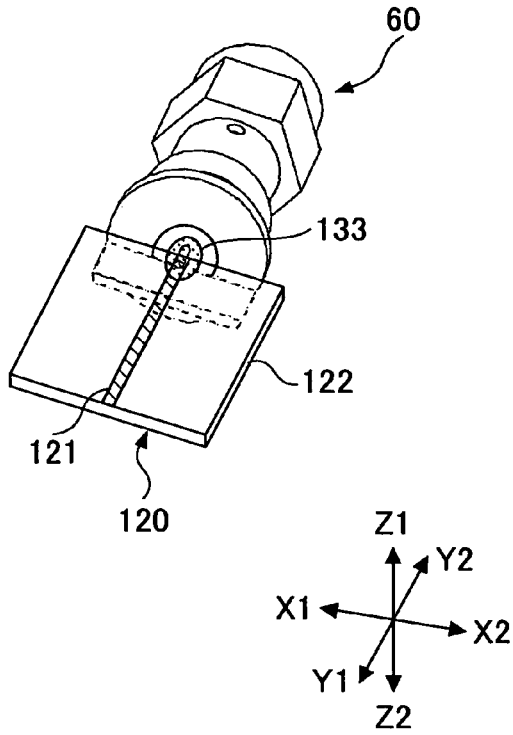

As shown in FIG. 8 and FIG. 9, the connecting board 120 is used to make it easier to electrically connect the Y2 end of the coaxial cable 110 extending from the UWB antenna 100 to the coaxial connector 60. For example, the connecting board 120 is composed of a polyimide board, a wiring pattern 121 on the front surface of the polyimide board, and a ground pattern 122 on the entire back surface of the polyimide board (see FIG. 10). The connecting board 120 fits in a space in the connector case 30.

[Coaxial Connector 60]

As shown in FIGS. 8A, 8B, 9A, 9B, and 10, the coaxial connector 60 is composed of a metal connector body 61, a core wire 62 running through the center of the connector body 61, an insulator 63 covering the core wire 62, the screw connector 64 at the Y2 end, and an O-ring 65 made of rubber and placed around the connector body 61. The connector body 61 includes a cylinder 61*a*, a flange 61*b*, and a bracket 61*c*. The O-ring 65 is placed around the cylinder 61*a*. A mark 66 is formed on the surface of the cylinder 61*a* in a position circumferentially opposite from the bracket 61*c* and close to the Y2 end.

The connecting board 120 is supported by the bracket 61*c* and the Y2 end of the connecting board 120 is placed between the bracket 61*c* and a protrusion 62*a* of the core wire 62. The end of the bracket 61*c* and a portion of the ground pattern 122 on the back surface of the connecting board 120 are soldered by solder 132. The protrusion 62*a* and the Y2 end of the wiring pattern 121 on the front surface of the connecting board 120 are soldered by solder 133. As described above, the connecting board 120 is at the Y1 end of the coaxial connector 60 and is fixed to the coaxial connector 60.

Figure 10:
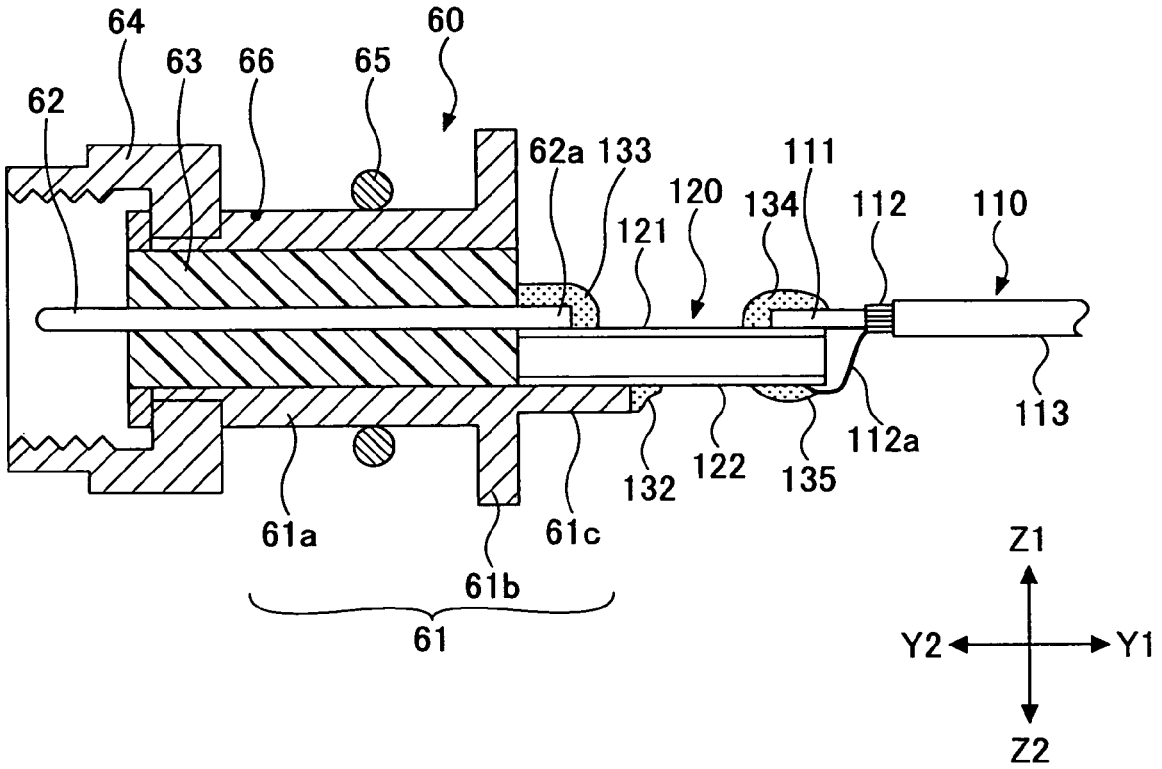
FIG. 10 is a cross-sectional view of a coaxial connector to which a connecting board is soldered.

Also, as shown in FIG. 10, the Y2 end of the electric wire 111 of the coaxial cable 110 is soldered to the Y1 end of the wiring pattern 121 by solder 134, and the end 112*a* of the braided wire 112 is soldered to the ground pattern 122 by solder 135.

In this way, the antenna 100 is electrically connected to the coaxial connector 60 via the coaxial cable 110 and the connecting board 120.

Instead of soldering, an electrically conductive adhesive or laser welding may be used.

For the connection between the coaxial cable 110 and the connecting board 120, high frequency connectors may also be used. In this case, a high frequency connector is attached to the Y2 end of the coaxial cable 110 and another high frequency connector is attached to the Y1 end of the connecting board 120, and the two high frequency connectors are joined.

Also, the Y2 end of the coaxial cable 110 may be directly connected to the protrusion 62*a*.

The mark 66 is not a printed mark but formed as a dent, and therefore will not be rubbed off.

[Antenna Case 11]

Figure 11A:
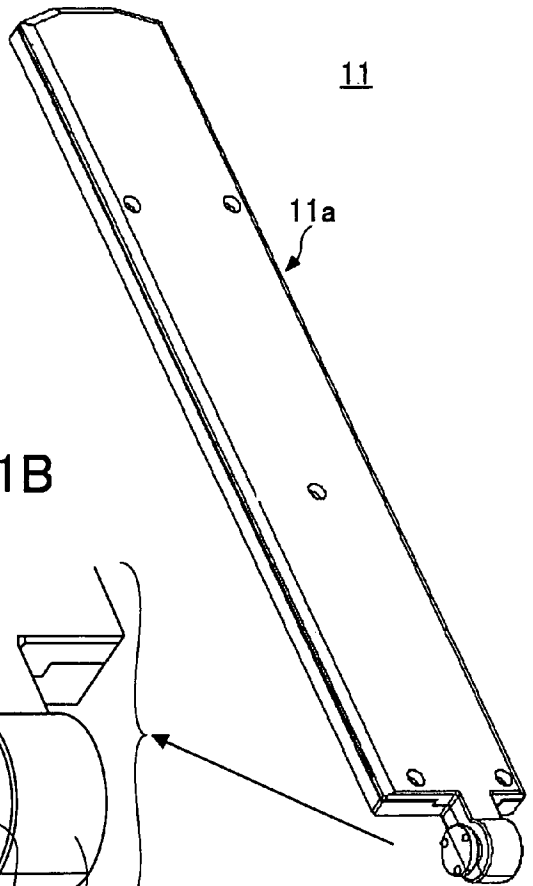
FIG. 11A is an entire perspective view of an antenna case.
Figure 11B:
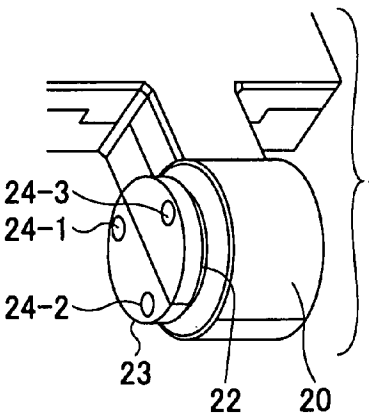
FIG. 11B is an enlarged view of an arm of the antenna case.
Figure 11C:
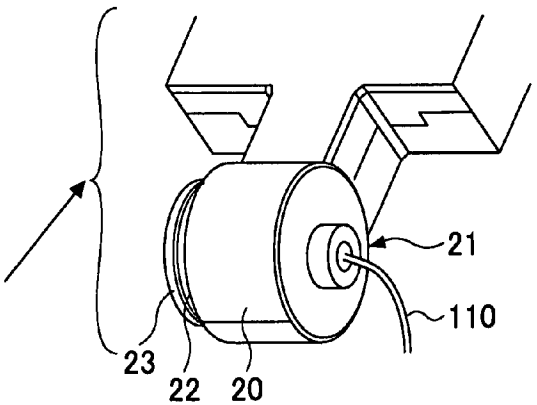
FIG. 11C is an enlarged view of rods of the antenna case.
Figure 12:
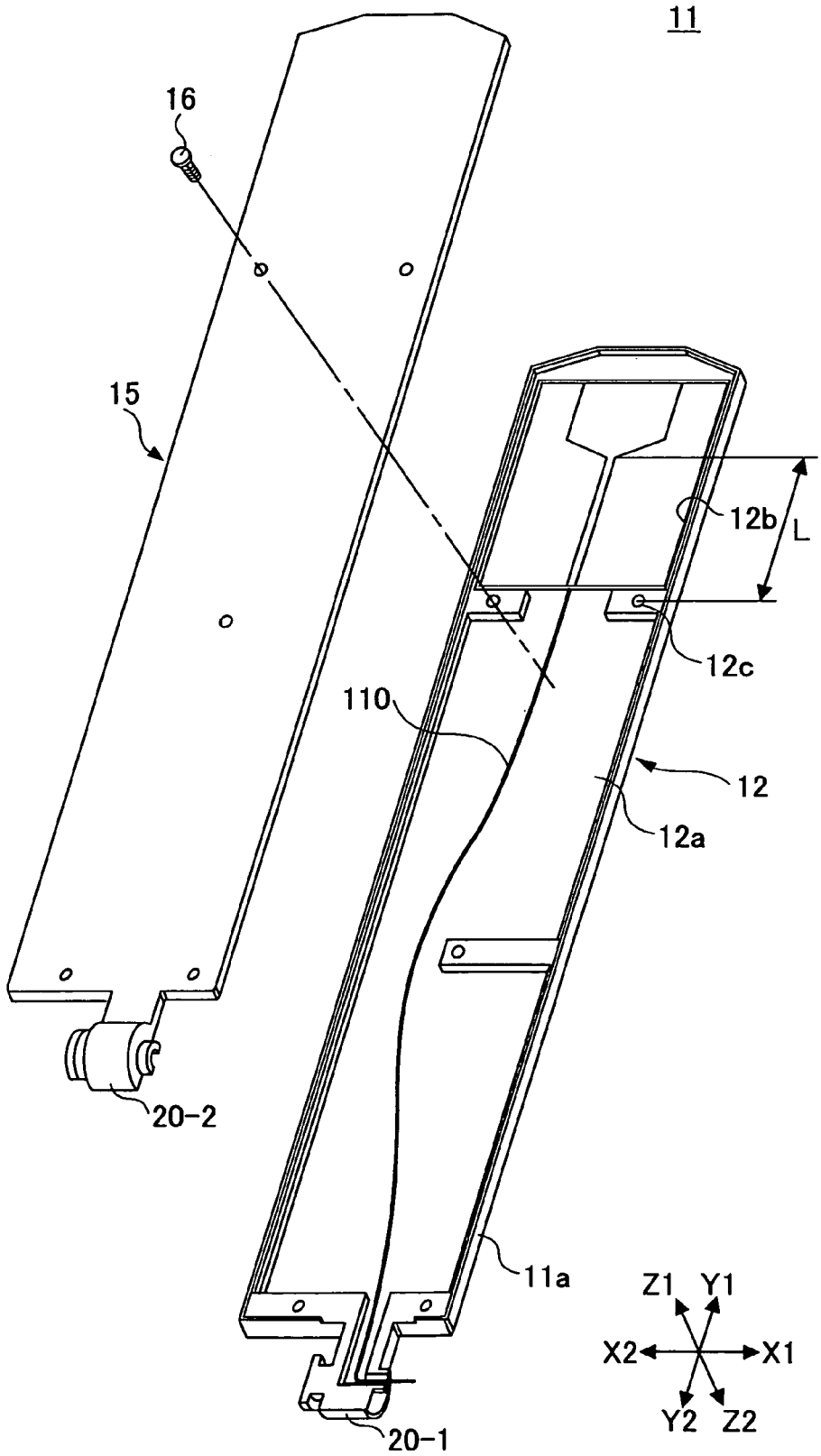
FIG. 12 is an exploded perspective view of an antenna case.
Figure 13:
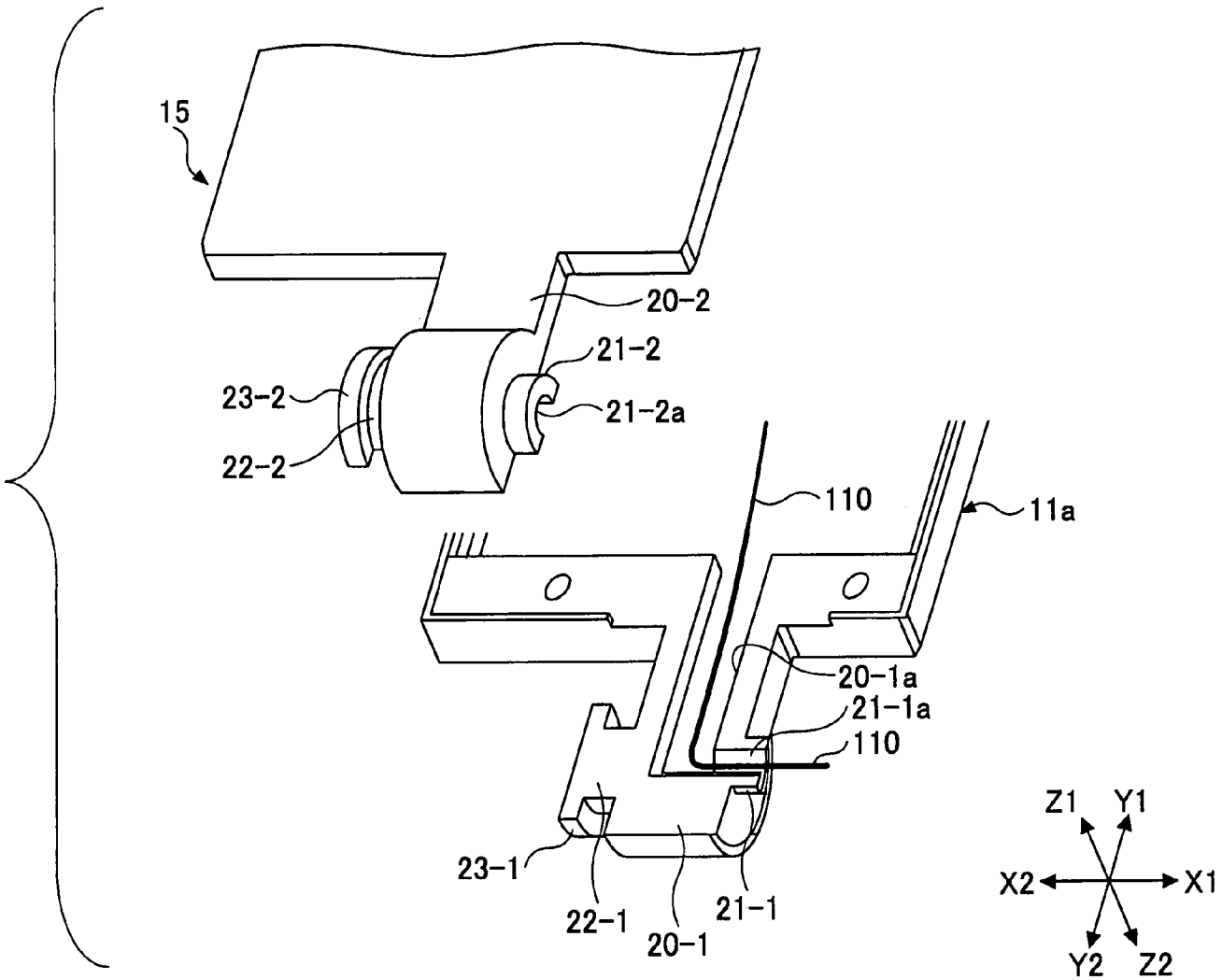
FIG. 13 is an enlarged perspective view of arm parts and rod parts shown in FIG. 12.

FIG. 11A is an entire perspective view of the antenna case 11; FIG. 11B is an enlarged view of an arm 20 of the antenna case 11; and FIG. 11C is an enlarged view of a first rod 21 and a second rod 22 of the antenna case 11. FIG. 12 is an exploded perspective view of the antenna case 11. FIG. 13 is an enlarged perspective view of arm parts and rod parts shown in FIG. 12.

The antenna case 11 is composed of a case body 12 and a cover 15 which are joined and fastened at five points with screws 16. The antenna case 11 is subdivided into an antenna case main part 11*a*, the arm 20 protruding from the Y2 end of the antenna case main part 11*a* in the Y2 direction, the first rod 21 protruding from the arm 20 in the X1 direction, and the second rod 22 protruding from the arm 20 in the X2 direction. The first rod 21 and the second rod 22 are aligned along the X1-X2 axis. The second rod 22 has a flange 23 at its end. The UWB antenna 100 is housed in the antenna case 11 near the Y1 end.

As shown in FIG. 12, the case body 12 has a shallow recess 12*a* in the Y2 side and a UWB antenna containing part 12*b* in the Y1 side. The case body 12 also has five threaded holes 12*c*, an arm part 20-1 protruding from the Y2 end of the case body 12, a first rod part 21-1, a second rod part 22-1, and a flange part 23-1.

A groove 20-1*a* is formed in the arm part 20-1; and a groove 21-1*a* is formed in the first rod part 21-1.

The cover 15 is subdivided into an arm part 20-2 protruding from the Y2 end, a first rod part 21-2, a second rod part 22-2, and a flange part 23-2. A groove (not shown) is formed in the arm part 20-2 and a groove 21-2*a* is formed in the first rod part 21-2.

The arm part 20-1, the first rod part 21-1, the second rod part 22-1, and the flange part 23-1; and the arm part 20-2, the first rod part 21-2, the second rod part 22-2, and the flange part 23-2 are respectively symmetric with respect to the X-Y plane.

As shown in FIG. 12, the antenna case 11 is assembled as follows. The UWB antenna 100 is placed in the UWB antenna containing part 12*b* of the case body 12. The coaxial cable 110 is laid loosely through the case body 12. Then, the coaxial cable 110 is laid along the grooves 20-1*a* and 21-1*a* to form an L-shape and to protrude from the end of the first rod 21-1. The cover 15 is placed on the case body 12 and fastened to the case body 12 at five points with the screws 16.

The arm part 20-1 and the arm part 20-2 together form the arm 20; the first rod part 21-1 and the first rod part 21-2 together form the first rod 21; the second rod part 22-1 and the second rod part 22-2 together form the second rod 22; and the flange part 23-1 and the flange part 23-2 together form the flange 23. The groove 20-1*a* and the corresponding groove (not shown) in the arm part 20-2 form a tunnel in the arm 20. The groove 21-1*a* and the groove 21-1*b* form a tunnel in the first rod 21.

The coaxial cable 110 runs through a flat space between the case body 12 and the cover 15, goes through the tunnels in the arm 20 and the first rod 21, and protrudes from the end of the first rod 21.

Three protrusions 24-1, 24-2, and 24-3 are formed on the X2 side of the flange 23.

The case body 12 and the cover 15 are made of a non-magnetic and non-metal material such as ABS resin. In the case body 12, no threaded hole 12*c* is provided near the element pattern 102 of the UWB antenna 100. A distance L between the element pattern 102 and the nearest threaded hole 12*c* is substantially long (see FIG. 12). Therefore, the antenna case 11 does not affect the element pattern 102.

Also, the screws 16 may be made of a synthetic resin so that the screws 16 do not affect the element pattern 102.

[Connector Case 30]

Figure 14:
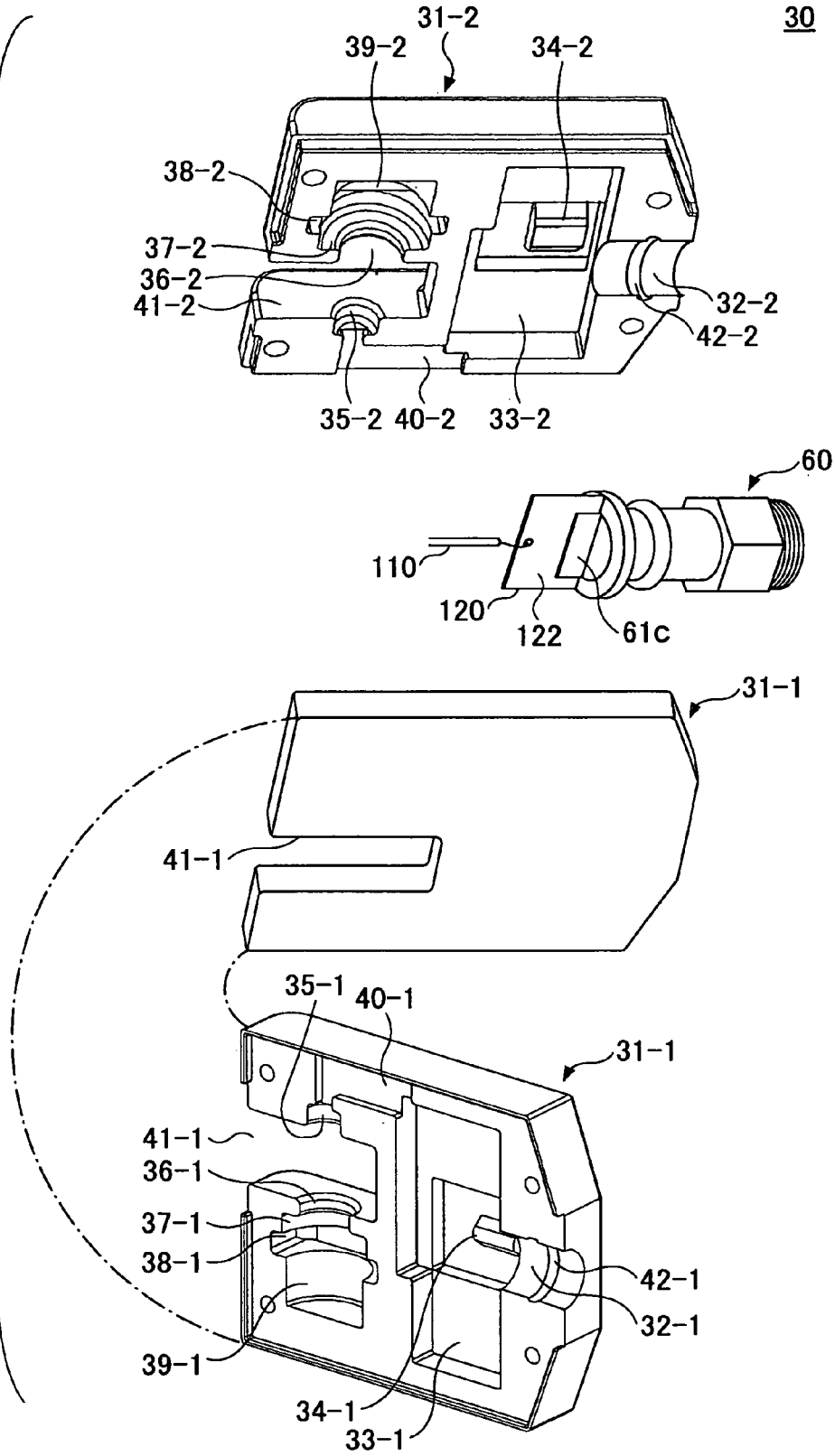
FIG. 14 is an exploded perspective view of a connector case.

FIG. 14 is an exploded perspective view of the connector case 30. The connector case 30 is composed of a lower connector case 31-1 and an upper connector case 31-2. The lower connector case 31-1 and the upper connector case 31-2 are made of a non-magnetic and non-metal material such as ABS resin. Between the lower connector case 31-1 and the upper connector case 31-2, the coaxial connector 60, the connecting board 120, the first rod 21 and the second rod 22 of the antenna case 11, and a stopper 90 are sandwiched.

As shown in FIG. 14, an arm space 41-1 for housing the arm 20 is formed in the Y1 side of the lower connector case 31-1. The lower connector case 31-1 has, on the upper side, a rod bearing 32-1 for holding the coaxial connector 60, a recess 33-1 to form the space 45 for holding the connecting board 120, a protrusion 34-1 protruding from the bottom of the recess 33-1, a rod bearing 35-1 for holding the first rod 21, a rod bearing 36-1 for holding the second rod 22, a flange hole 37-1 for holding the flange 23, a stopper hole 38-1 for holding the stopper 90, a helical compression spring hole 39-1 for holding a helical compression spring 95, and a groove 40-1 for holding the coaxial cable 110. The rod bearing 32-1 has an O-ring groove 42-1 for holding the O-ring 65.

The upper connector case 31-2 has substantially a similar structure as the lower connector case 31-1. The upper connector case 31-2 has a rod bearing 32-2, a recess 33-2, a protrusion 34-2, a rod bearing 35-2, a rod bearing 36-2, a flange hole 37-2, a stopper hole 38-2, a helical compression spring hole 39-2, a groove 40-2, an arm space 41-2, and an O-ring groove 42-2.

The connector case 30 is assembled as described below.

Figure 15:
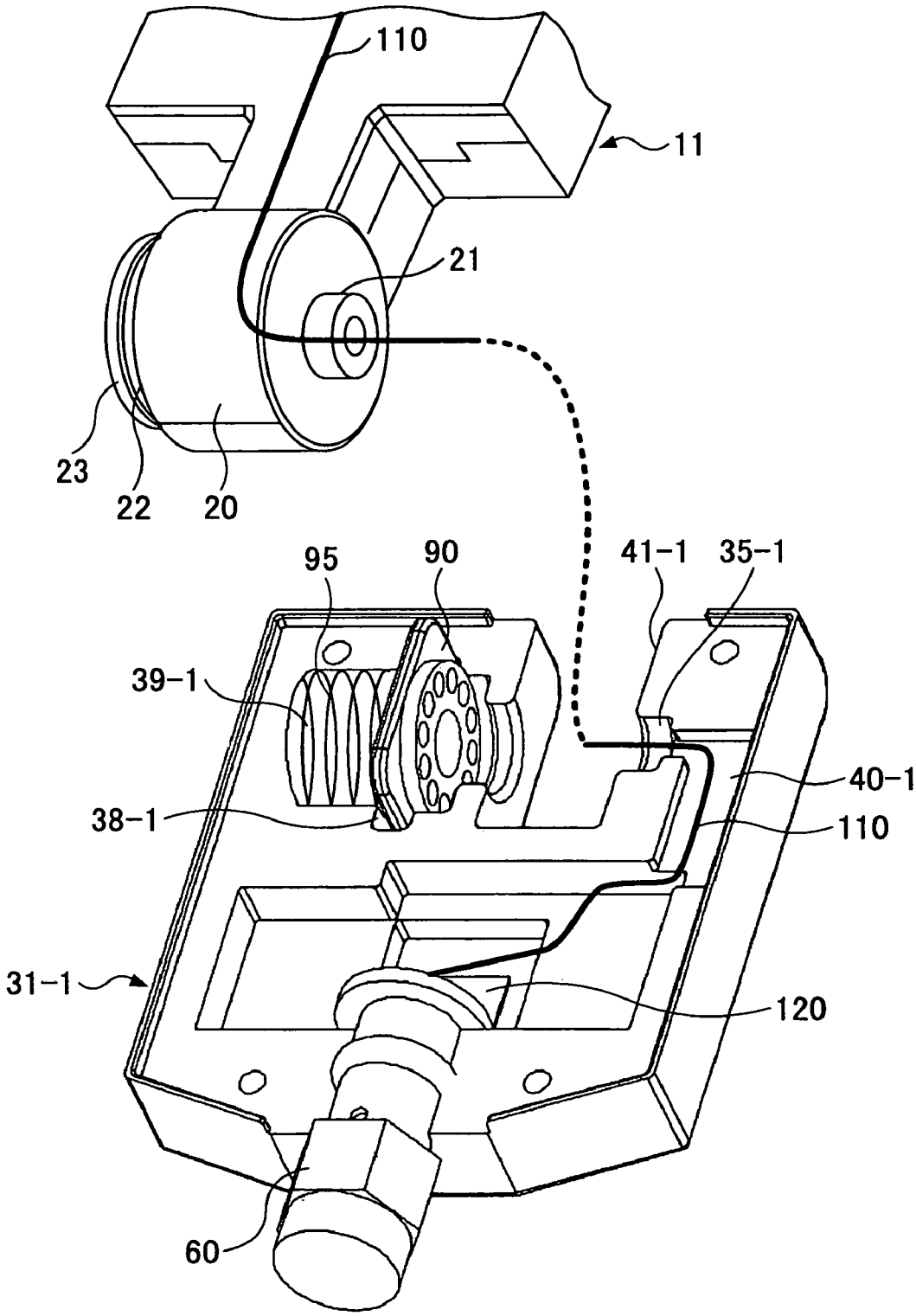
FIG. 15 is a drawing used to describe how a connector case is assembled.

As shown in FIG. 15, the stopper 90 is placed in the stopper hole 38-1 of the lower connector case 31-1, the helical compression spring 95 is placed in the helical compression spring hole 39-1, the arm 20 is placed in the arm space 41-1, the first rod 21 is placed in the rod bearing 35-1, the second rod 22 is placed in the rod bearing 36-1, and the flange 23 is placed in the flange hole 37-1. Also, the coaxial connector 60 as shown in FIG. 10 is placed in the rod bearing 32-1. The coaxial cable 110 is laid along the groove 40-1 and laid loosely through the recess 33-1.

Then, the upper connector case 31-2 is placed on the lower connector case 31-1. The Z1 side of the coaxial connector 60 is placed in the rod bearing 32-2, the Z1 side of the first rod 21 is placed in the rod bearing 35-2, the Z1 side of the second rod 22 is placed in the rod bearing 36-2, the Z1 side of the flange 23 is placed in the flange hole 37-2, the Z1 side of the stopper 90 is placed in the stopper hole 38-2, and the Z1 side of the helical compression spring 95 is placed in the helical compression spring hole 39-2. The recess 33-1 and the recess 33-2 together form the space 45 (see FIG. 16).

Finally, the upper connector case 31-2 is fastened to the lower connector case 31-1 with screws.

As described above, the connector case 30 is assembled by sandwiching a part of the antenna case 11, a part of the coaxial connector 60, the stopper 90, and the helical compression spring 95 between the lower connector case 31-1 and the upper connector case 31-2, thereby forming the connector case supporting mechanism 70 and the antenna case supporting mechanism 80.

The tightening strength of the above screws determines how much the O-ring 65 is pressed, and thereby determines the rotational friction of the connector case supporting mechanism 70.

The upper connector case 31-2 has a mark 46 (see FIG. 1).

Figure 16:
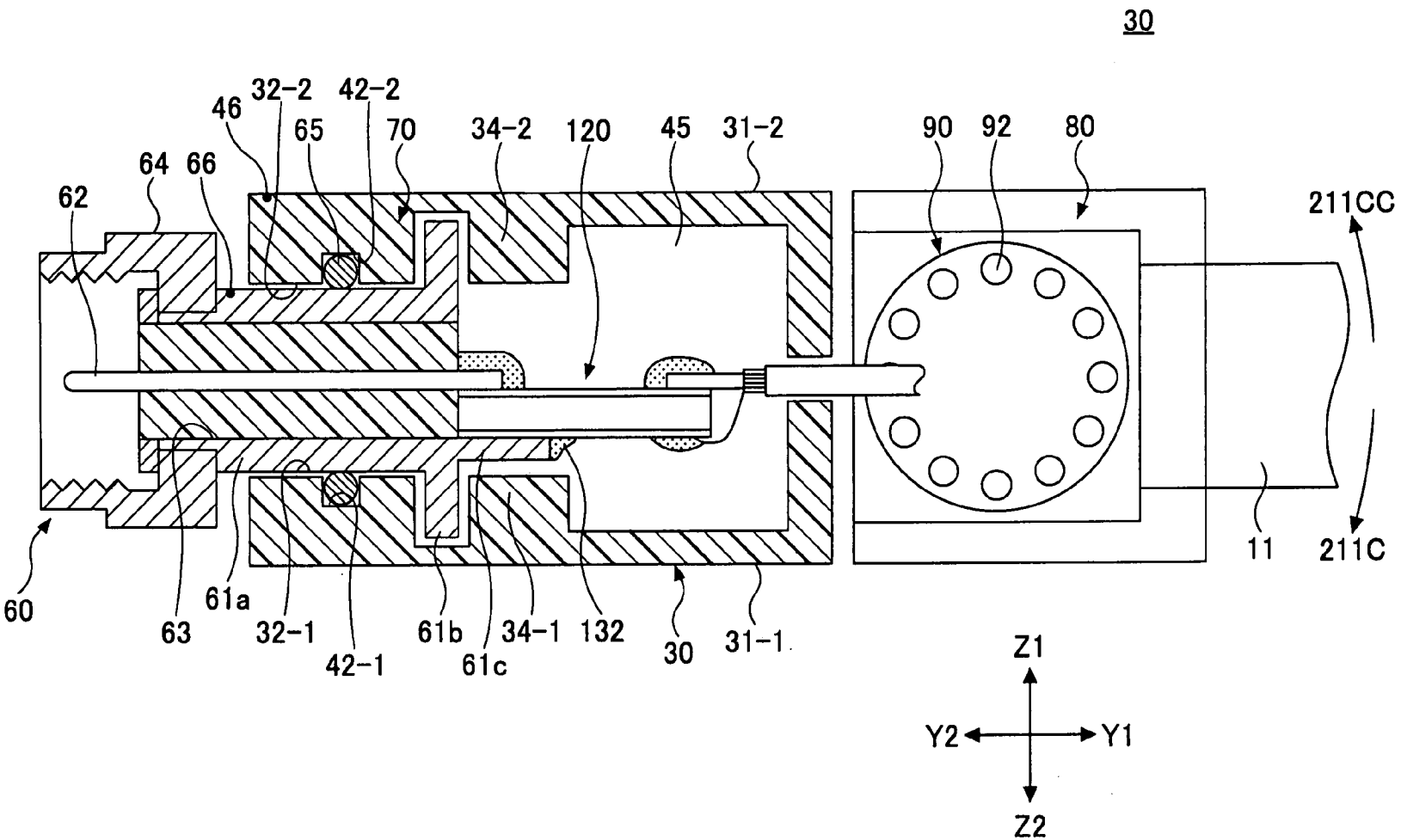
FIG. 16 is a cross-sectional view of a connector case taken along line XVI-XVI shown in FIG. 1.
Figure 17:
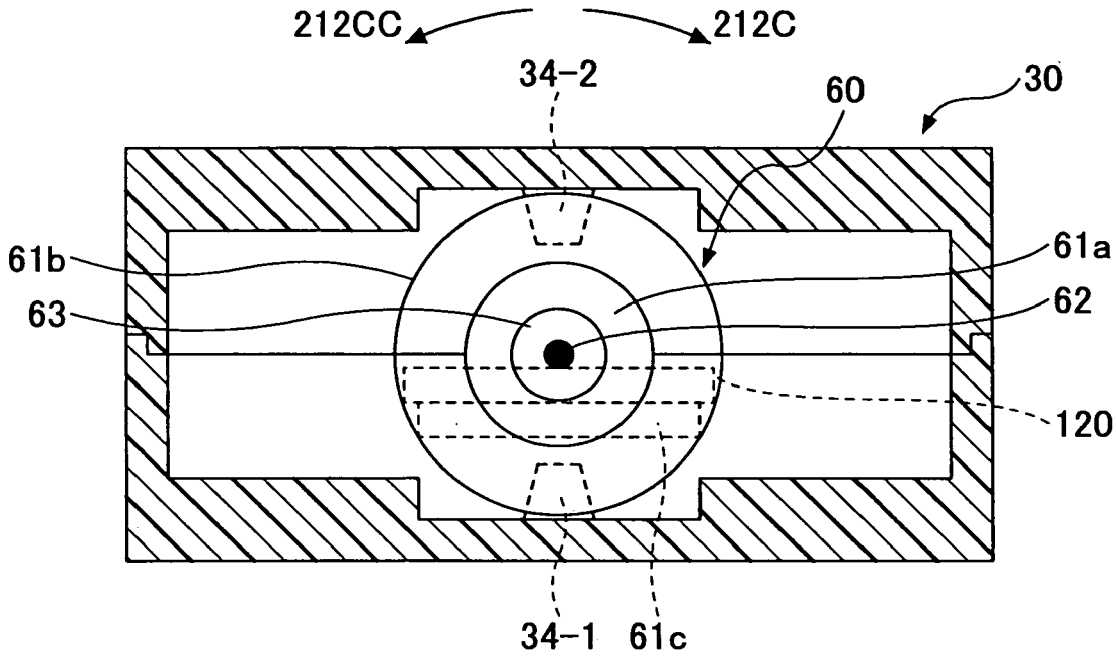
FIG. 17 is a cross-sectional view of a connector case taken along line XVII-XVII shown in FIG. 1.

FIG. 16 and FIG. 17 show the inside of the connector case 30. FIG. 16 is a cross-sectional view of the connector case 30 taken along line XVI-XVI shown in FIG. 1. FIG. 17 is a cross-sectional view of the connector case 30 taken along line XVII-XVII shown in FIG. 1.

[Connector Case Supporting Mechanism 70]

As shown in FIG. 16, the connector case supporting mechanism 70 has a structure where the coaxial connector 60 is sandwiched between the rod bearings 32-1 and 32-2. The connecting board 120 and the bracket 61*c* are housed in the space 45 in the connector case 30.

The above structure enables rotating the connector case 30 around the connector body 61 of the coaxial connector 60.

As shown in FIG. 17, the protrusion 34-1 is positioned close to the Z2 side of the bracket 61*c*.

Figure 18A:
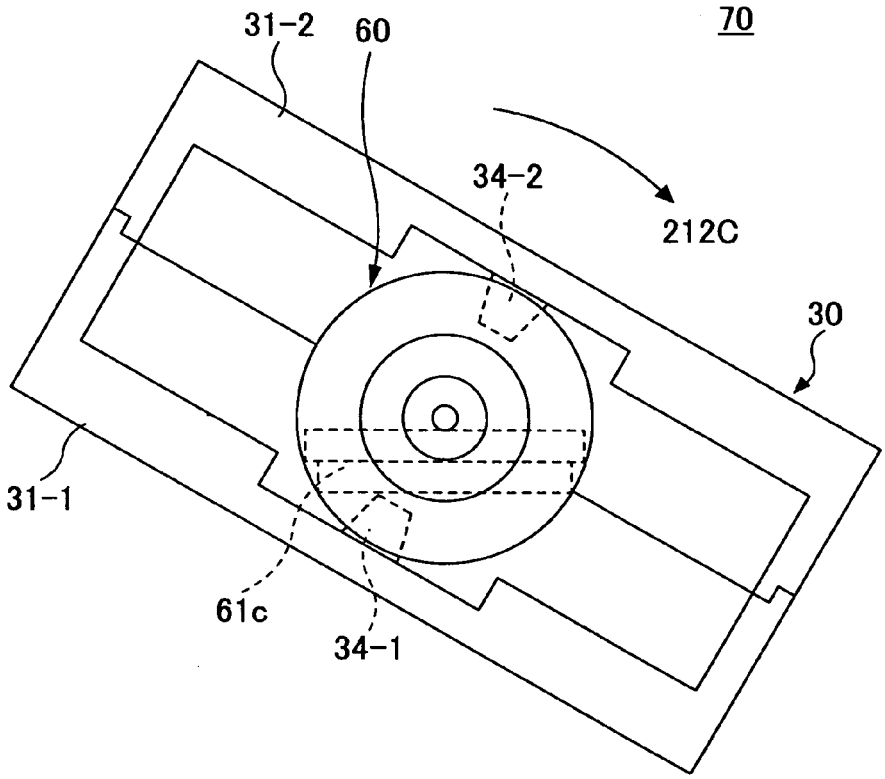
FIGS. 18A and 18B are drawings illustrating the angle within which a connector case can be rotated.

When the user holds the connector case 30 and rotates the connector case 30 clockwise around the connector body 61 as indicated by the arrow 212C in FIG. 17, the protrusion 34-1 comes into contact with the bracket 61*c* as shown in FIG. 18A. When the user holds the connector case 30 and rotates the connector case 30 counterclockwise around the connector body 61 as indicated by the arrow 212CC in FIG. 17, the protrusion 34-1 comes into contact with the bracket 61*c* as shown in FIG. 18B.

Figure 18B:
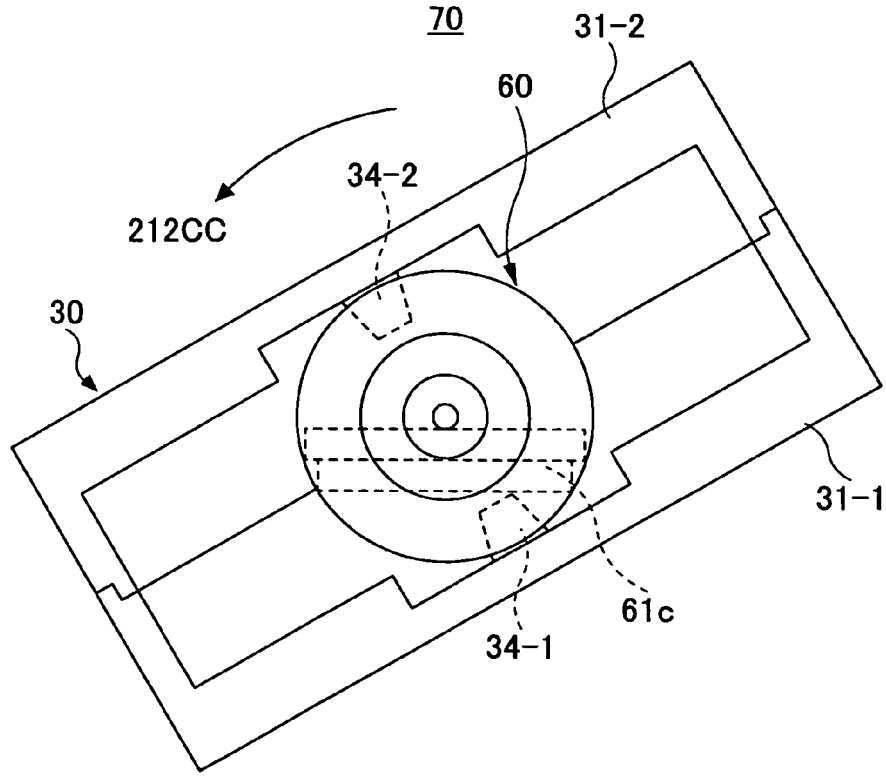

Such a structure limits the rotation of the connector case 30 around the connector body 61 to within the angle β (about 100 degrees) between the positions shown in FIGS. 18A and 18B. Limiting the rotation of the connector case 30 to within the angle β prevents twisting the coaxial cable 110 too much, and thereby prevents breaking the coaxial cable 110 or disconnecting the coaxial cable 110 from the solder 134 and 135.

The space 45 is large enough so that the connecting board 120 housed in the connector case 30 does not obstruct the rotation of the connector case 30. Therefore, the connecting board 120 does not rotate together with the connector case 30.

The connector case 30 is kept at a desired angle by the friction between the O-ring 65 and the connector body 61. The strength of this frictional force is adjustable by tightening/loosening the screws fastening the upper connector case 31-2 to the lower connector case 31-1.

Also, the movement of the coaxial connector 60 in the Y1 and Y2 directions in the connector case 30 is limited by the flange 61*b* and the protrusions 34-1 and 34-2.

Also, as shown in FIG. 16, the mark 66 is provided on the outside of the connector case 30. Since the Y2 end of the coaxial connector 60 has an approximately round shape, it is difficult to determine its direction. With the mark 66 and the mark 46 on the connector case 30, the user can easily determine the angle between the connecting board 120 and the connector case 30. Since the connector case 30 has an approximately square shape and its direction can be easily determined, the mark 46 on the connector case 30 may be omitted.

The groove for the O-ring 65 may be provided on the connector body 61 of the coaxial connector 60. In this case, the O-ring grooves 42-1 and 42-2 in the lower connector case 31-1 and the upper connector case 31-2 are omitted.

The connector case supporting mechanism 70 may also be configured so that the protrusion 34-1 comes into contact with the connecting board 120 when the connector case 30 is rotated, thereby limiting the rotation of the connector case 30 around the connector body 61.

[Antenna Case Supporting Mechanism 80]

Figure 19:
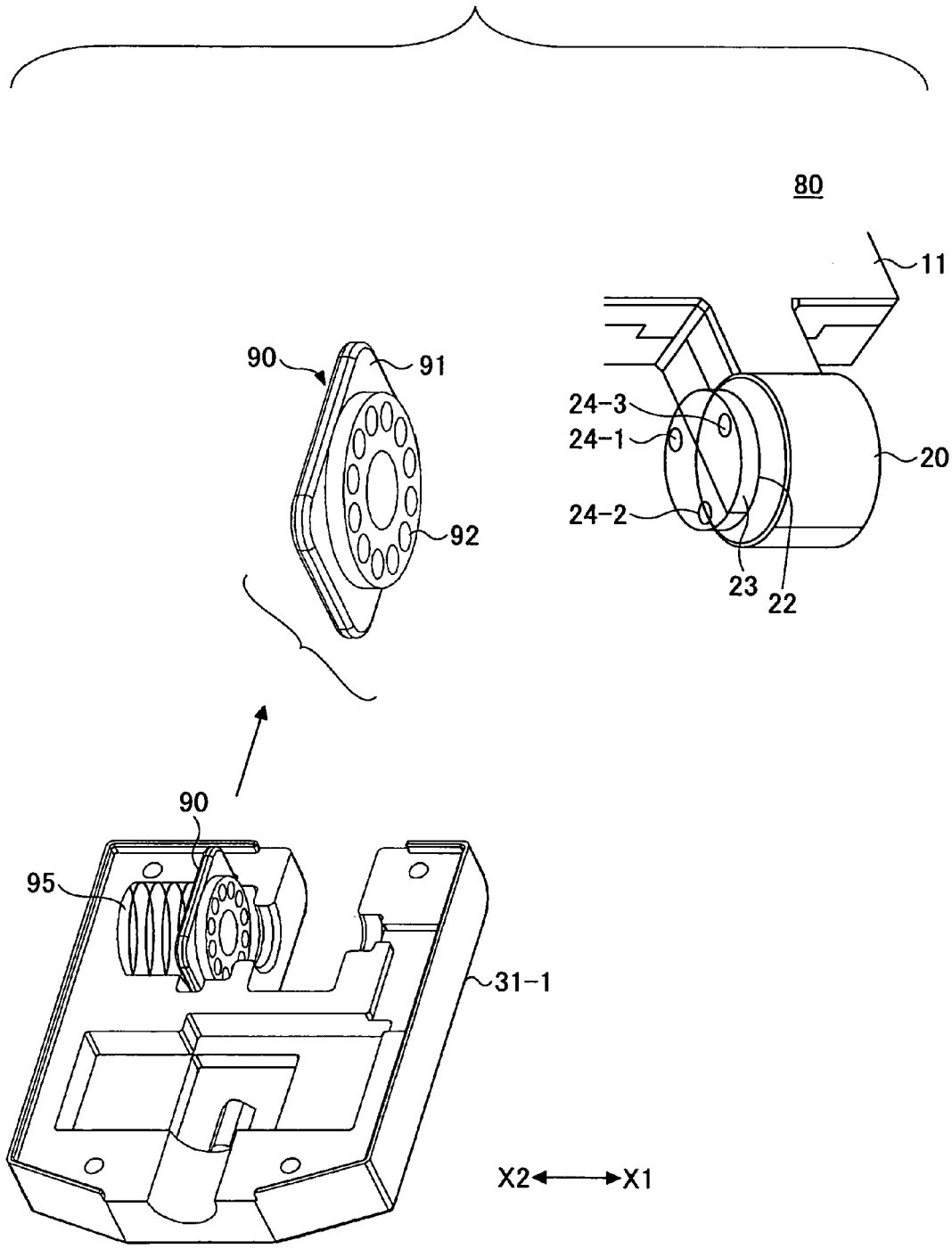
FIG. 19 is an exploded perspective view of an antenna case supporting mechanism.

FIG. 19 is an exploded perspective view of the antenna case supporting mechanism 80 shown in FIG. 16.

The antenna case supporting mechanism 80 has a structure where the first rod 21 and the second rod 22 are rotatably supported by the rod bearings 35-1, 36-1, 35-2, and 36-2. The antenna case supporting mechanism 80 also includes the flange 23, the stopper 90, and the helical compression spring 95.

The flange 23 is placed between the flange holes 37-1 and 37-2 and limits the movement of the first rod 21 and the second rod 22 in the X1 and X2 directions.

The stopper 90 has a structure where twelve holes 92 are formed at 30 degree intervals along the circumference of a circular part on a square board 91.

The stopper 90 is placed between the stopper holes 38-1 and 38-2 of the connector case 30 so that the stopper 90 cannot be rotated. The helical compression spring 95 presses the stopper 90 in the X1 direction.

Three protrusions 24-1, 24-2, and 24-3 on the X2 side of the flange 23 fit into three of the twelve holes 92 on the stopper 90.

When the user holds and rotates the antenna case 11 in the direction indicated by an arrow 211C or 211CC, the protrusions 24-1, 24-2, and 24-3 push back the stopper 90 in the X2 direction against the pressure of the helical compression spring 95 and are released from the three holes 92. When the user further rotates the antenna case 11, the protrusions 24-1, 24-2, and 24-3 are placed into the next set of three holes 92. In this way, the antenna case 11 is rotated stepwise and locked at 30 degree intervals within the angle α between +120 degrees and −120 degrees as shown in FIG. 3. The antenna case 11 can be locked at 0 degrees, +30 degrees, +60 degrees, +90 degrees (upward vertical position), +120 degrees, −30 degrees, −60 degrees, −90 degrees (downward vertical position), and −120 degrees.

The pressure of holes 92 against the protrusions 24-1, 24-2, and 24-3 is provided constantly by the helical compression spring 95.

As described above, the antenna case 11 is locked by the three protrusions 24-1, 24-2, and 24-3 engaging three of the holes 92. This locking mechanism provides a locking force three times greater than that provided by a locking mechanism where one protrusion engages one hole, enabling secure locking of the antenna case 11.

Also, such a three-point locking mechanism provides better durability compared with a one-point locking mechanism, since the contact pressure is distributed to the three points (protrusions).

The bearings 35-1, 36-1, 35-2, and 36-2, the first rod 21, and the second rod 22 are lubricated. Therefore, the antenna case 11 can be rotated smoothly.

The protrusions 24-1, 24-2, and 24-3 may be formed on the stopper 90; and the holes 92 may be formed on the flange 23.

A spring made of a synthetic resin may be used instead of the helical compression spring 95. The locking force of the locking mechanism as described above can be adjusted by changing the strength of the helical compression spring 95 or a synthetic resin spring. Also, the locking force of the locking mechanism can be increased by pressing the helical compression spring 95 further by inserting a spacer in the X2 end of the helical compression spring hole 39-1. Further, a helical compression spring or a similar spring for pressing the flange 23 in the X2 direction may be incorporated in the arm 20.

A different type of antenna may be used instead of the UWB antenna. Also, a different type of connector may be used instead of the coaxial connector 60.

The present invention is not limited to the specifically disclosed embodiments, and variations and modifications may be made without departing from the scope of the present invention.

The present application is based on Japanese Priority Application No. 2005-378396 filed on Dec. 28, 2005 with the Japanese Patent Office, the entire contents of which are hereby incorporated by reference.

What is claimed is:

1. An antenna apparatus, comprising:

an antenna case housing an antenna;

a connector to be connected to a device which connector is electrically connected to the antenna;

a connector case which holds the connector; and an antenna case supporting mechanism which supports the antenna case and enables changing a position of the antenna case at least to a horizontal position and a vertical position with respect to the connector case, the antenna case supporting mechanism being formed using a part of the connector case and having protrusions and holes that engage each other and lock the antenna case at positions including the horizontal position and the vertical position.

2. The antenna apparatus as claimed in claim 1, wherein the antenna case supporting mechanism is configured so that two or more of the protrusions and two or more of the holes engage each other to lock the antenna case at a position.

3. The antenna apparatus as claimed in claim 1, wherein the antenna is a UWB antenna.

4. The antenna apparatus as claimed in claim 1, wherein the connector is a coaxial connector.

5. An antenna apparatus, comprising:

an antenna case housing an antenna;

a connector to be connected to a device which connector is electrically connected to the antenna via a cable;

a connector case which holds the connector; and an antenna case supporting mechanism which supports the antenna case and enables changing a position of the antenna case at least to a horizontal position and a vertical position with respect to the connector case, wherein the connector includes a connecting board connected to one end of the cable, and the connecting board is housed in the connector case.

6. An antenna apparatus, comprising:

an antenna case housing an antenna;

a connector to be connected to a device which connector is electrically connected to the antenna via a cable;

a connector case which holds the connector; an antenna case supporting mechanism which supports the antenna case and enables changing a position of the antenna case at least to a horizontal position and a vertical position with respect to the connector case; and a connector case supporting mechanism which supports the connector case and enables rotating the connector case with respect to an axis of the connector, wherein the antenna case supporting mechanism has protrusions and holes which engage each other and lock the antenna case at positions including at least the horizontal position and the vertical position.

7. The antenna apparatus as claimed in claim 6, wherein the connector case supporting mechanism includes an O-ring; and the connector case is kept at a rotated position by friction between the O-ring and the connector.

8. The antenna apparatus as claimed in claim 6, wherein the connector includes a connecting board connected to one end of the cable;

the connector case has an internal space where the connecting board is housed;

the internal space has enough room so that the connecting board does not obstruct rotation of the connector case; and the connecting board does not rotate together with the connector case when the connector case is rotated by using the connector case supporting mechanism with respect to the axis of the connector.

9. The antenna apparatus as claimed in claim 6, wherein a protrusion is provided in the connector case; and when the connector case is rotated a predetermined angle by using the connector case supporting mechanism with respect to the axis of the connector, the protrusion comes into contact with the connector or the connecting board and thereby limits rotation of the connector case.

* * * * *